US007771171B2

(12) United States Patent
Mohr et al.

(10) Patent No.: US 7,771,171 B2
(45) Date of Patent: Aug. 10, 2010

(54) SYSTEMS FOR PREVENTING WEAR ON TURBINE BLADE TIP SHROUDS

(75) Inventors: Patrick Mohr, Greer, SC (US); Daniel Nowak, Greenville, SC (US); Emilio Fernandez, Taylors, SC (US); Michael Arnett, Simpsonville, SC (US); David Williams, Seneca, SC (US); Carlos Collado, Moore, SC (US)

(73) Assignee: General Electric Company, Schenectady, NY (US)

( * ) Notice: Subject to any disclaimer, the term of this patent is extended or adjusted under 35 U.S.C. 154(b) by 789 days.

(21) Appl. No.: 11/638,818

(22) Filed: Dec. 14, 2006

(65) Prior Publication Data

US 2008/0145207 A1 Jun. 19, 2008

(51) Int. Cl.
*F01D 5/22* (2006.01)

(52) U.S. Cl. ..... 416/191; 416/196 R; 416/212 A; 416/224

(58) Field of Classification Search ..... 415/173.1, 415/173.6, 173.4, 174.4; 416/189, 191, 192, 416/195, 196 R, 212 A, 224
See application file for complete search history.

(56) References Cited

U.S. PATENT DOCUMENTS 1,335,002 A * 3/1920 Johnson ..... 416/224
1,999,739 A * 4/1935 Rasmussen ..... 416/174
4,257,741 A * 3/1981 Betts et al. ..... 416/190
4,784,571 A * 11/1988 Ferleger ..... 416/191
5,083,903 A * 1/1992 Erdmann ..... 416/190
6,164,916 A * 12/2000 Frost et al. ..... 416/189
7,001,152 B2 * 2/2006 Paquet et al. ..... 416/190
7,134,838 B2 * 11/2006 Dube et al. ..... 415/173.5
2004/0124231 A1 * 7/2004 Hasz et al. ..... 228/245

FOREIGN PATENT DOCUMENTS

JP 07091206 4/1995

OTHER PUBLICATIONS

European Patent Office Search Report.

* cited by examiner

*Primary Examiner*—Ninh H Nguyen
(74) *Attorney, Agent, or Firm*—Mark E. Henderson; Ernest G. Cusick; Frank A. Landgraff

(57) ABSTRACT

A system in a turbine engine for preventing wear on a tip shroud of a turbine blade that includes a pocket formed in a contact surface of the tip shroud and a plug that fits within the pocket and has a durable outer surface. The durable outer surface may include a cobalt-based hardfacing powder. The pocket may be machined out of the contact surface, and the plug may include a plug of predetermined size that fits snugly into the pocket. In some embodiments, the durable outer surface may substantially align with the contact surface after the plug is fitted into the pocket. In other embodiments, the durable outer surface may remain slightly raised from the contact surface after the plug has been fitted into the pocket.

15 Claims, 3 Drawing Sheets

SYSTEMS FOR PREVENTING WEAR ON TURBINE BLADE TIP SHROUDS

TECHNICAL FIELD

This present application relates generally to systems for preventing wear on the tip shrouds of turbine blades in turbine engines. More specifically, but not by way of limitation, the present application relates to systems for integrating a durable outer surface onto the contact faces between adjacent tip shrouds.

BACKGROUND OF THE INVENTION

Turbine blades generally include an airfoil and a tip shroud attached thereto. The tip shroud, which attaches to the outer edge of the airfoil, provides a surface area that runs substantially perpendicular to the airfoil surface. The surface area of the tip shroud helps to hold the turbine exhaust gases on the airfoil (i.e., does not allow the exhaust gases to slide over the end of the airfoil blade) so that a greater percentage of energy from the turbine exhaust gases may be converted into mechanical energy by the turbine. Thusly, tip shrouds improve the performance of gas turbine engines. The preferred tip shroud design calls for a large tip shroud surface area such that the entire outer surface of the airfoil of the turbine blade is covered.

During turbine operation, a tip shroud generally interacts with the tip shrouds of adjacent turbine blades. That is, because of the alignment of installed turbine blade and the preferred tip shroud design, a tip shroud generally makes contact with the tip shrouds on each side of it, i.e., the adjacent tip shroud on its leading edge and trailing edge. The contact that is made between the tip shrouds of adjacent turbine blades also may help to hold the turbine exhaust gases on the airfoil (i.e., prevent significant leakage between the tip shrouds) such that turbine performance is enhanced. However, given the rotational velocity and vibration of the turbine in operation and the non-permanent nature of the joint made between adjacent tip shrouds, the physical and mechanical stresses associated with the contact between adjacent tip shrouds are extreme.

In addition, turbine blades of industrial gas turbines and aircraft engines operate in a high temperature environment. In general, the temperatures in the turbine where the turbine blades operate are between 600 and 1500° C. Further, the rapidity and frequency of changes in turbine operating temperatures exacerbate the thermal stresses applied to hot-path components. As a result, the thermal stresses on turbine blades and the tip shrouds attached thereto are extreme.

Turbine blades and tip shrouds attached to them generally are made of nickel-based super alloys, cobalt-based super alloys, iron-based alloys or similar materials. While these materials have proven cost-efficient and effective for most necessary functions, given the extreme mechanical and thermal stresses, the connective area between adjacent tip shrouds (i.e., where a tip shroud contacts each of the tip shrouds adjacent to it) tend to wear prematurely. Other harder/more durable materials are more effective at resisting the kind of wear that occurs at the contact areas between adjacent tip shrouds.

Conventional methods and systems have been unsuccessful at preventing this wear in an effective manner. For example, flame spray coatings; have been tried. However, such coatings have proven to be too thin to provide any long-lasting protection. Specialized welding, which generally constitutes "weld build-up," in the contact area also has been tried. However, specialized welding also has shown to provide little protection. Further, weld build-up introduces further heat related stresses to the contact area, when operational stresses in this area already are extreme.

As a result, premature wear at the contact point between adjacent tip shrouds continues to result in system inefficiencies. For example, premature wear may cause: 1) increased repair downtime to the turbine unit; 2) replacement of otherwise healthy tip shrouds due to the premature wear in the area of contact; and 3) related increases in labor and part expenses. Thus, there is a need for improved systems for protecting against premature wear between adjacent tip shrouds.

BRIEF DESCRIPTION OF THE INVENTION

The present application thus describes a system in a turbine engine for preventing wear on a tip shroud of a turbine blade. The system may include a pocket formed in a contact surface of the tip shroud and a plug that fits within the pocket and has a durable outer surface. In some embodiments, the durable outer surface may include a cobalt-based hardfacing powder.

The pocket may be machined out of the contact surface, and the plug may include a plug of predetermined size that fits snugly into the pocket. In some embodiments, the durable outer surface may substantially align with the contact surface after the plug is fitted into the pocket. In other embodiments, the durable outer surface may remain slightly raised from the contact surface after the plug has been fitted into the pocket.

In some embodiments, the tip shroud may come into contact with an adjacent tip shroud during the operation of the turbine at the contact surface. The contact surface may include a Z-interface, the Z-interface having an approximate profile of a "Z". The tip shroud further may include a cutting tooth that forms a ridge down the middle of a top surface of the tip shroud. The Z-interface may include a middle contact face that corresponds to a middle leg of the approximate "Z" profile, the middle contact face having a substantially rectangular shape that substantially corresponds to a cross-sectional shape of the cutting tooth. The height of the pocket may be the approximate thickness of the tip shroud at either the upper contact face or the lower contact face.

In some embodiments, the pocket may be open through a lower interior face. The plug may be brazed into the pocket. In other embodiments, the durable outer surface of the plug may oppose a second durable outer surface of a second plug of the adjacent tip shroud.

The present application also describes a system in a turbine engine for preventing wear on a tip shroud of a turbine blade that may include a plate attached to a contact surface of the tip shroud. The plate may include a durable outer surface. In some embodiments, the durable outer surface comprises a cobalt-based hardfacing powder.

The tip shroud may come into contact with an adjacent lip shroud during the operation of the turbine at the contact surface. In some embodiments, the contact surface may include a Z-interface, the Z-interface having an approximate profile of a "Z". The tip shroud further may include a cutting tooth that forms a ridge down the middle of a top surface of the tip shroud. The Z-interface may include a middle contact face that corresponds to a middle leg of the approximate "Z" profile, the middle contact face having a substantially rectangular shape that corresponds to the approximate cross-sectional shape of the cutting tooth. In some embodiments, the plate may be substantially rectangular and cover approximately all of the middle contact surface.

The system may further include a dowel opening in the plate and the contact face for the insertion of a dowel. The durable outer surface of the plate may oppose a second durable outer surface of a second plate of the adjacent tip shroud. In some embodiments, the plate may include a lip that, upon installation of the plate against the contact surface, engages an edge of the contact surface. These and other features of the present application will become apparent upon review of the following detailed description of the preferred embodiments when taken in conjunction with the drawings and the appended claims.

DETAILED DESCRIPTION OF THE INVENTION

Figure 1:
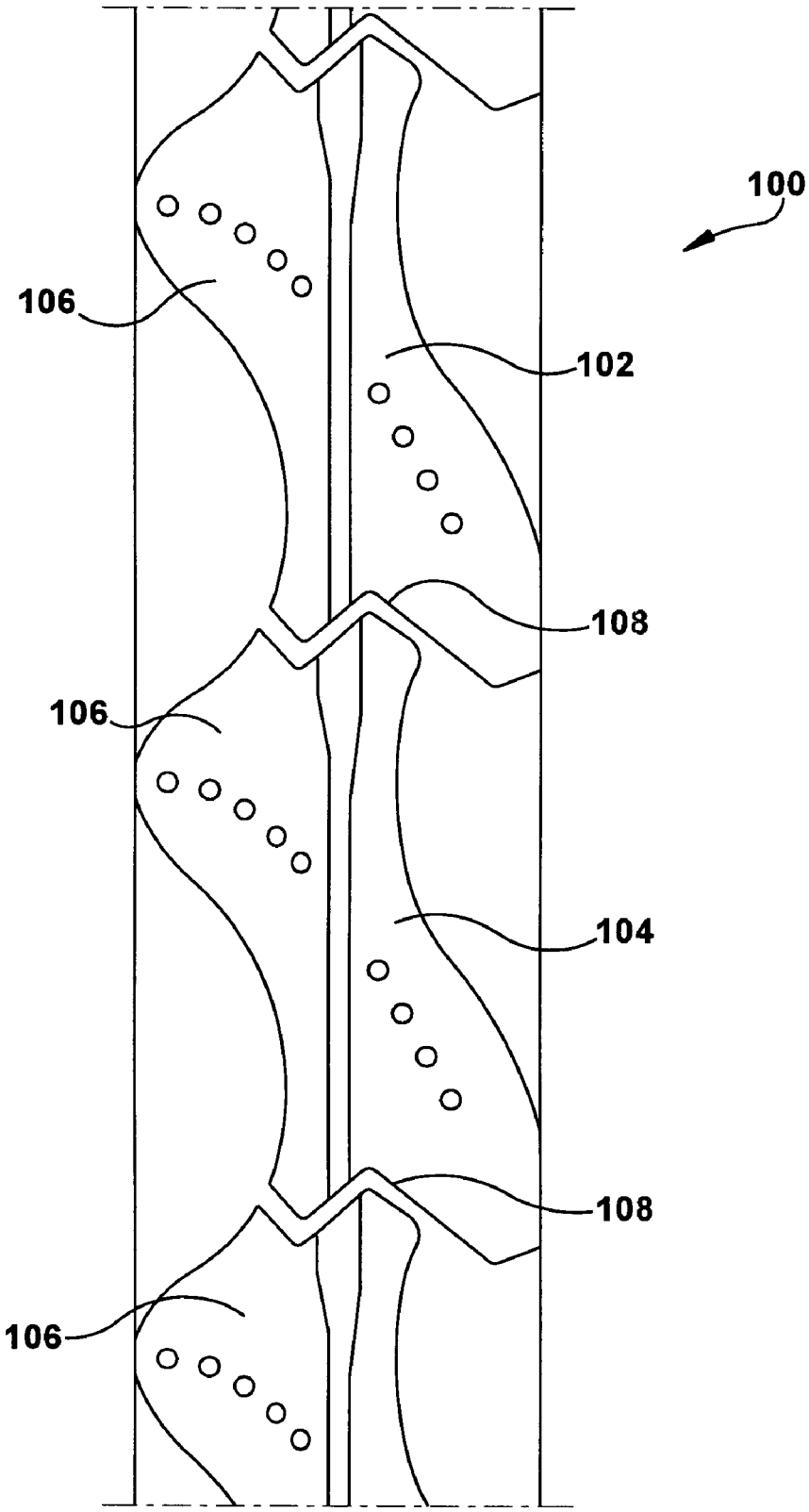
FIG. 1 is a top view of the tip shrouds of turbine blades installed on the rotor.

Referring now to the figures, where the various numbers represent like parts throughout the several views, FIG. 1 illustrates a top view of turbine blades 100 as assembled on a turbine rotor (not shown). A turbine blade 102 may be adjacent to a turbine blade 104. As visible from the top view, each turbine blade 100 may have a tip shroud 106. The leading edge of the tip shroud 106 of turbine blade 104 may contact or come in close proximity to the trailing edge of the tip shroud 106 of turbine blade 102. This area of contact may be referred to as a contact face or a Z-interface 108. As shown from the perspective of FIG. 1, the Z-interface 108 may from a rough "Z" profile between the two edges of the tip shrouds 106. Those of ordinary skill in the art will appreciate that the use of the turbine blade 100 and the tip shroud 106 are exemplary only and that other turbine blades and tip shrouds of different configurations may be used with alternative embodiments of the current application. Further, the use of a "Z" shaped interface is exemplary only.

The turbine blades 100 also may have a cutting tooth 110. The cutting tooth 110 may run lengthwise down the outer face (i.e., the top) of each of the tip shrouds 106. The cutting tooth 110 may form a ridge or a sharp protrusion down the middle of the tip shroud 110. In operation, the cutting tooth 110 may be used to form a labyrinth seal with an area of soft metal attached to stationary shrouds fixed to the turbine casing.

When the turbine is in a non-operating "cold" state, a narrow space may exist at the Z-interface 108 between the edges of adjacent tip shrouds 106. When the turbine is operating in a "hot" state, the expansion of the turbine blade metal may cause the gap to narrow such that the edges of adjacent tip shrouds 106 make contact. Other operating conditions, including the high rotation speeds of the turbine and the related vibration, may cause additional contact between adjacent tip shrouds 106, even where a gap in the Z-interface 108 remains during turbine operation. The contact occurring at the Z-interface 108 between the two tip shrouds 106 may occur most heavily at the middle leg of the "Z", i.e., the leg that intersects with the cutting tooth 110. The reasons for this are the center positioning of this leg and the increased surface area of it compared to the other legs of the "Z".

Figure 2:
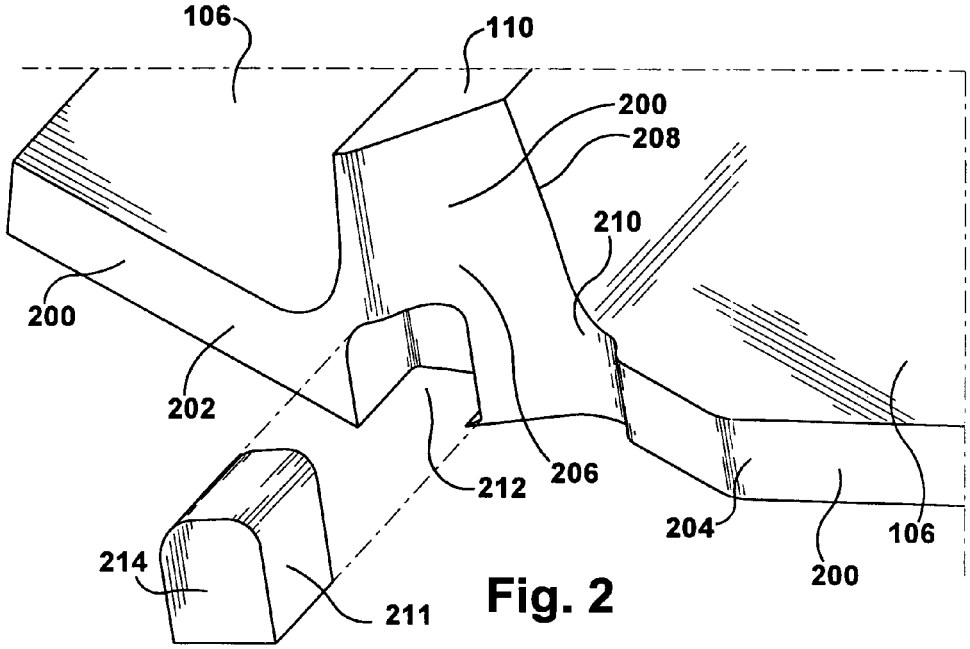
FIG. 2 is a view demonstrating a plug with a durable outer surface and a pocket according to an exemplary embodiment of the present application.

FIG. 2 illustrates a contact face 200, according to an exemplary embodiment of the present application. Because the exemplary embodiment provided herein are discussed in relation to a "Z" shaped interface between tip shrouds 106, the contact face 200 also may be referred to as a Z-interface 108 and, thus, may include three sections. Each of the sections may correspond to one of the legs of the "Z". Accordingly, an upper contact face 202, which may correspond to the upper leg of the "Z" shaped interface, may be substantially rectangular in shape and be relatively short in profile. A lower contact face 204, which may correspond to the lower leg of the "Z" shaped interface, may be similar, also being substantially rectangular in shape and relatively short in profile. A middle contact face 206 may correspond with the middle leg of the Z-shaped interface. The middle contact face 206 also may be substantially rectangular in shape. Because of the cutting tooth 110, the middle contact face 206 may be relatively tall when compared to the upper contact face 202 and lower contact face 204. At an interior side 208 of the middle contact face 206, the middle contact face 206 may curve toward the lower contact face 204 so to form a transition radius 210 between the two faces. 4

FIG. 2 further illustrates a plug 211. The plug 211 may be a pre-formed plug of predetermined size that fits snugly into a pocket 212 that has been machined out of the middle contact face 206. The plug 211 may have a durable outer surface 214 that substantially aligns with the middle contact face 206 after the plug 211 has been fitted into the pocket 212. The material of the durable outer surface 214 may consist of a cobalt-based hardfacing powder or other similar materials. In some embodiments, the material of the durable outer surface 214 may consist of a high-percentage of cobalt-based hardfacing powder and a low-percentage of brazing powder. Such materials may effectively withstand the physical and thermal stresses associated the area of contact between two adjacent tip shrouds 106. The plug 211 may be entirely composed of the material of the durable outer surface 214. In alternative embodiments, it may be cost effective for the remainder of the plug 211 to be composed of a different material than that of the durable outer surface 214.

The pocket 212, as described, may be machined into the surface of the middle contact face 206. As shown, the size of the pocket 212 may be approximately 25% of the surface area of the middle contact face, though this percentage may significantly increase or decrease depending on the application. From the perspective of FIG. 2, the pocket 212 may be positioned in a lower/outer quadrint of the middle contact face 206. While in alternative embodiments the pocket 212 may be positioned in other areas of the middle contact face 206, the positioning in the lower/outer quadrant may allow the durable outer surface 214 to absorb a significant amount of the contact wear that occurs between adjacent tip shrouds 106. In some alternative embodiments, the pocket 212 may extend further toward the transition radius 210. In other alternative embodiments, the pocket also may extend upward toward the upper edge of the cutting tooth 110. In some embodiments and as shown in FIG. 2, the height of the pocket 212 may be the approximate thickness of the tip shroud 106 along the upper contact face 202 and lower contact face 204.

The pocket 212 also may be open (i.e., accessible) through another of its interior surfaces. For example, as shown, the lower face of the pocket 212 has been machined away during the machining process and, thus, is open. This design may make the machining process for the pocket 212 more efficient.

In some alternative embodiments, the durable outer surface 214 of the plug 211 may remain slightly raised from the surface of the middle contact surface 206 after the plug 211 has been installed into the pocket 212. The slightly raised condition of the durable outer surface 214 may allow the durable outer surface 214 to absorb a greater percentage of the physical contact wear that occurs between adjacent tip shrouds 106, which may thus better protect the other non-enhanced contact surfaces 200 of the tip shroud.

In operation, the plug 211 may be fitted into the pocket 212 and fixed in place by conventional methods, which may include a brazing process. Because turbine blades 100 generally require a final heat treatment before installation, employing the brazing process for attachment may be efficient because the brazing process may be done in conjunction with the heat treatment such that no additional process step is required. A plug 211 may be installed in each of the adjacent tip shrouds 106 (i.e., the leading and trailing edges of each of the tip shrouds 106) such that, once installed, the plugs 211 oppose each other across the Z-interface 108. In this manner, during operation, the plugs 211 of adjacent tip shrouds 106 would essentially only contact each other. Accordingly, once installed, the durable outer surfaces 214 of the adjacent tip shrouds 106 may absorb much of the contact wear that occurs between the adjacent turbine shrouds 102, thus protecting, the other (less durable) contact surfaces of the tip shroud 106.

In certain embodiments of the present application, the plug 211 may be dislodged and replaced with a new plug 211 after a certain amount of operational wear has occurred. In this manner, the useful life of the turbine blade 100 and the tip shroud 106 may be extended. Specifically, otherwise healthy turbine blades 100 or tip shrouds may not need to be replaced because of concentrated wear on the contact surfaces 200 of the tip shroud 106. Further, the plug 211 may be installed into an otherwise healthy turbine blade 100 that has experienced such concentrated wear on its contact surfaces 200. In this manner, the operational life of the turbine blade 100 may be extended.

During operation, the plug 211 may be efficiently held -into place by the design of the pocket 212, i.e., the pocket design may efficiently handle the physical stresses associated with the extreme rotational speeds of, the turbine. More specifically, as shown in FIG. 2, the design of the pocket and the rotational direction of the turbine rotor may cause the plug 211 to be held firmly against an interior wall of the pocket 212. Thus, the rotational forces acting on the plug 211 during turbine operation do not act to dislodge it, but act to hold it snug against an interior surface of the pocket 212. The brazing connection, or other attachment methods, may be sufficient and efficiently used to hold the plug 211 in place.

Figure 3:
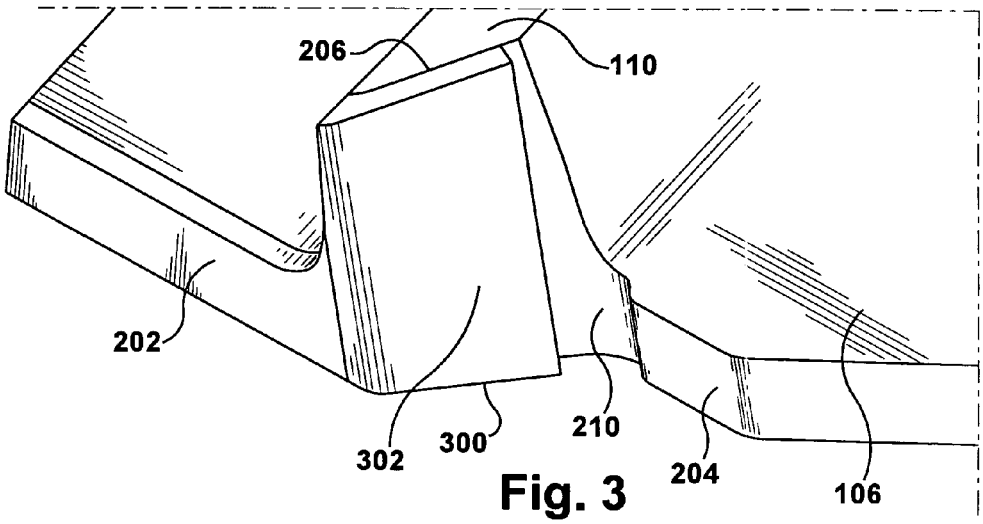
FIG. 3 is a view demonstrating a plate with a durable outer surface installed on a tip shroud according to an exemplary embodiment of the present application.

FIG. 3 illustrates an alternative embodiment of the present application, which includes a plate 300. The plate 300 may be a pre-formed thin plate of predetermined size that attaches to and substantially covers the middle contact face 206 of the tip shroud 106. In alternative embodiments, the plate 300 may be sized such that it covers less than substantially all of the middle contact face 206. At an outer surface of the plate 300 (i.e., the surface that, once installed, would oppose the contact surface 200 of an adjacent tip shroud 106), the plate 300 may include a durable outer surface 302. The material of the durable outer surface 302 may consist of a cobalt-based hardfacing powder or other similar materials. In some embodiments, the material of the durable outer surface 302 may consist of a high-percentage of cobalt-based hardfacing powder and a low-percentage of brazing powder. Such materials may effectively withstand the physical and thermal stresses associated the area of contact between two adjacent tip shrouds 106. The plate 300 may be entirely composed of the material of the durable outer surface 302. In alternative embodiments, it may be cost effective for the remainder of the plate 300 to be composed of different material than that of the durable outer surface 302.

In operation, a flat inner surface (which is not able to be seen in FIG. 3) of the plate 300 may be affixed to the flat surface of the middle contact face 206 by conventional methods, which may include a brazing process. As described, because turbine blades 100 generally require a final heat treatment before installation, employing the brazing process for attachment may be efficient because the brazing process may be done in conjunction with the heat treatment such that no additional process step is required. The plate 300 may be installed in each of the adjacent tip shrouds 106 (i.e., the leading and trailing edges of each of the tip shrouds 106) such that, once installed, the plates 300 oppose each other across the Z-interface 108. In this manner, during operation, the plates 300 of adjacent tip shrouds 106 would essentially only contact each other. Accordingly, once installed, the durable outer surfaces 302 of the adjacent tip shrouds 106 may absorb much of the contact wear that occurs between the adjacent turbine shrouds 106, thus protecting the other (less durable) contact surfaces of the tip shroud 106.

In certain embodiments of the present application, the durable surface plate 300 may be removed and replaced with a new plate 300 after a certain amount of operational wear has occurred. In this manner, the useful life of the turbine blade 100 and the tip shroud 106 may be extended. In other words, otherwise healthy turbine blades 100 or tip shrouds will not need to be replaced because of concentrated wear on the contact surfaces 200 of the tip shroud 106. In addition, the plate 300 may be installed into an otherwise healthy turbine blade 100 that has experienced such concentrated wear on its contact surfaces 200. In this manner, the operation life of the turbine blade 100 may be extended.

Figure 4:
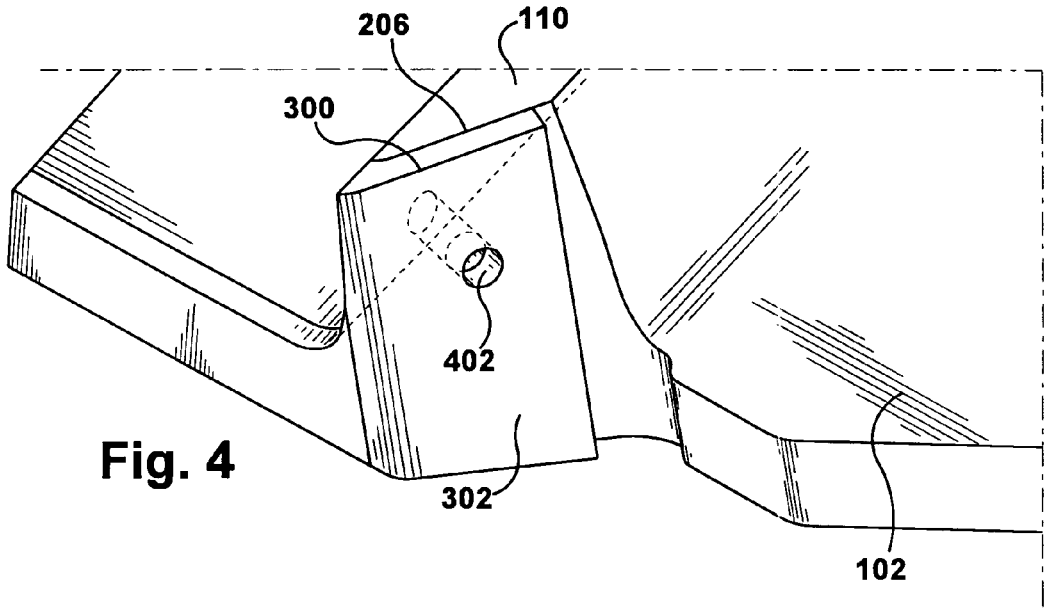
FIG. 4 is a view demonstrating a dowel opening through a plate and a tip shroud according to an exemplary embodiment of the present application.

During operation, the plate 300 may be held into place by the brazing (or similar type of) seal between the flat inner surface of the plate 300 and the middle contact face 206 of the tip shroud 106. In some instances, however, it may be beneficial to augment the brazing seal between the two flat surfaces. In such cases, as illustrated in FIG. 4, dowel openings 402 may be made through (or into and not all the way through) the middle contact face 206 and the plate 300 such that the two openings align once the plate 300 is affixed to the middle contact face 206. A dowel (not shown) then may then be inserted in the dowel opening 402 and attached therein through conventional methods, such as brazing. In this manner, the connection between the plate 300 and the middle contact face 206 of the tip shroud 106 may be enhanced such that it may better withstand the physical stresses associated with the extreme rotational speeds of the turbine.

Figure 5:
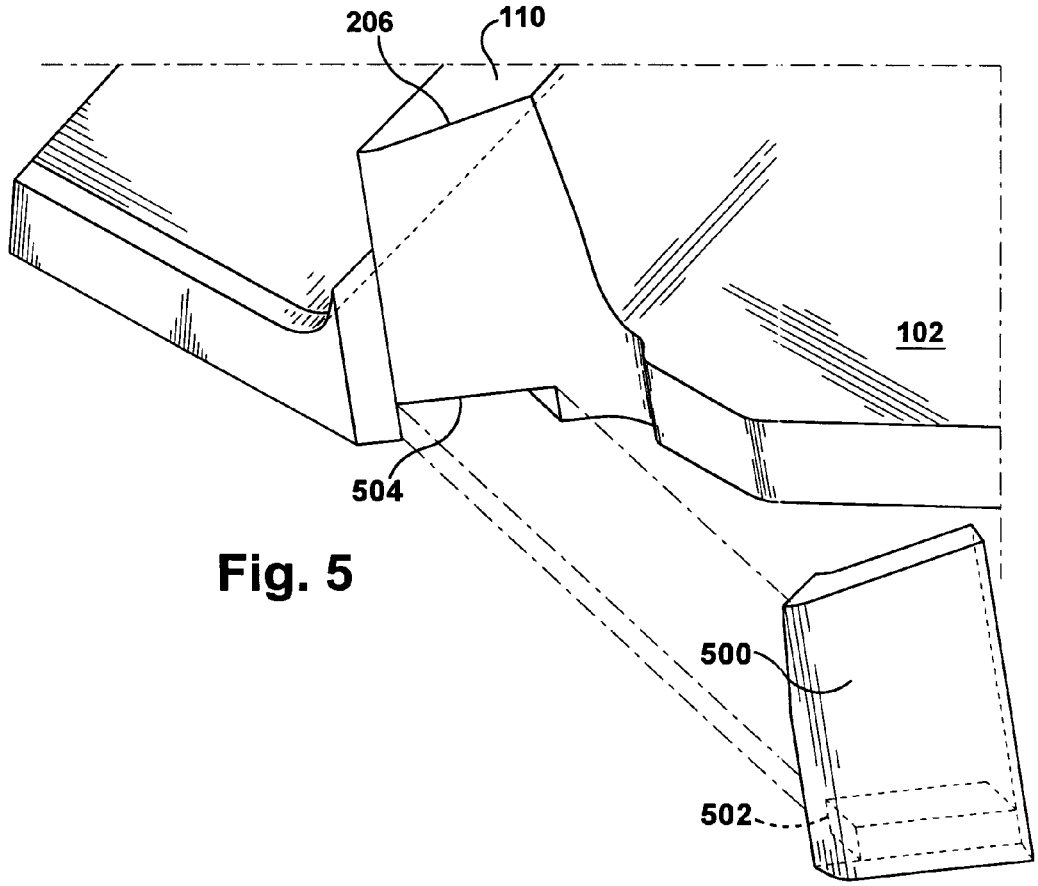
FIG. 5 is a view demonstrating a plate with a durable outer surface with a lip installed on a tip shroud according to an exemplary embodiment of the present application.

In other embodiments, as illustrated in FIG. 5, a plate 500 that is shaped like an "L" may be used. The plate 500 may be similar to the plate 300, but may have a lip 502. The lip 502 may fit within a groove 504 that is machined out of the middle contact face 206, as shown, or may curl around the lower edge of the middle contact face 206. In this manner, the lip 502 may engage an edge of the middle contact face 206. Further, when installed, the lip 502 may be oriented such that it opposes the forces applied to the plate 500 by the rotation of the turbine such that the lip 502 may aid in securing the plate 500 to the middle contact face 206. That is, for example, the rotational forces acting on the plate 500 during turbine operation may act to hold the lip 502 against the groove 504, which may assist in preventing the plate 500 from coming dislodged. As such, a brazing connection, or other similar attachment method, may be sufficient and efficiently used to hold the plate 500 against the middle contact face 206.

It should be apparent that the foregoing relates only to the described embodiments of the present application and that numerous changes and modifications may be made herein without departing from the spirit and scope of the application as defined by the following claims and the equivalents thereof. Specifically, those of ordinary skill in the art will appreciate that alternative embodiments of the present application may be used with tip shrouds of different design as the exemplary tip shrouds discussed herein.

We claim:

1. A system in a turbine engine for preventing wear on a tip shroud of a turbine blade, the system comprising:

a pocket formed in a contact surface of the tip shroud; and a rigid plug that fits within the pocket and has a durable outer surface;

wherein:

the tip shroud comes into contact with an adjacent tip shroud during the operation of the turbine at the contact surface;

the contact surface comprises a Z-interface, the Z-interface having an approximate profile of a "Z";

the tip shroud further comprises a cutting tooth that forms a ridge down the middle of a top surface of the tip shroud; and the Z-interface includes a middle contact face that corresponds to a middle leg of the approximate "Z" profile, the middle contact face having a substantially rectangular shape that substantially corresponds to a cross-sectional shape of the cutting tooth.

2. The system of claim 1, wherein the durable outer surface comprises a cobalt-based hardfacing powder.

3. The system of claim 1, wherein the pocket is machined out of the contact surface and the plug comprises a plug of predetermined size that fits snugly into the pocket.

4. The system of claim 3, wherein the pocket is open through a lower interior face.

5. The system of claim 1, wherein the durable outer surface substantially aligns with the contact surface after the plug is fitted into the pocket.

6. The system of claim 1, wherein the durable outer surface remains slightly raised from the contact surface after the plug has been fitted into the pocket.

7. The system of claim 1, wherein the height of the pocket comprises the approximate thickness of the tip shroud at either the upper contact face or the lower contact face.

8. The system of claim 1, wherein the plug is brazed into the pocket.

9. The system of claim 1, wherein the durable outer surface of the plug opposes a second durable outer surface of a second plug of the adjacent tip shroud.

10. A system in a turbine engine for preventing wear on a tip shroud of a turbine blade, the system comprising a rigid plate attached to a contact surface of the tip shroud, wherein the plate includes a durable outer surface;

wherein:

the tip shroud comes into contact with an adjacent tip shroud during the operation of the turbine at the contact surface;

the contact surface comprises a Z-interface, the Z-interface having an approximate profile of a "Z";

the tip shroud further comprises a cutting tooth that forms a ridge down the middle of a top surface of the tip shroud; and the Z-interface includes a middle contact face that corresponds to a middle leg of the approximate "Z" profile, the middle contact face having a substantially rectangular shape that corresponds to the approximate cross-sectional shape of the cutting tooth.

11. The system of claim 10, wherein the durable outer surface comprises a cobalt-based hardfacing powder.

12. The system of claim 10, wherein the plate is substantially rectangular and covers approximately all of the middle contact surface.

13. The system of claim 10, further comprising a dowel opening in the plate and the contact face for the insertion of a dowel.

14. The system of claim 10, wherein the durable outer surface of the plate opposes a second durable outer surface of a second plate of the adjacent tip shroud.

15. The system of claim 10, wherein the plate includes a lip that, upon installation of the plate against the contact surface, engages an edge of the contact surface.

* * * * *